US012358044B2

(12) United States Patent
Sgro' et al.

(10) Patent No.: US 12,358,044 B2
(45) Date of Patent: Jul. 15, 2025

(54) CRYSTALLIZER FOR THE CONTINUOUS CASTING OF A METAL PRODUCT, AND CORRESPONDING CASTING METHOD

(71) Applicant: DANIELI & C. OFFICINE MECCANICHE S.P.A., Buttrio (IT)

(72) Inventors: Antonio Sgro', Via San Paolino d'Aquileia (IT); Andrea De Luca, Remanzacco (IT); Massimiliano Isera, Trieste (IT); Luca Entesano, Udine (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 0 days.

(21) Appl. No.: 18/243,321

(22) Filed: Sep. 7, 2023

(65) Prior Publication Data

US 2023/0415223 A1 Dec. 28, 2023

Related U.S. Application Data

(63) Continuation of application No. 17/614,718, filed as application No. PCT/IT2020/050162 on Jun. 26, 2020, now Pat. No. 11,780,001.

(30) Foreign Application Priority Data

Jun. 28, 2019 (IT) ..... 102019000010347

(51) Int. Cl.
*B22D 11/04* (2006.01)
*B22D 11/00* (2006.01)
(Continued)

(52) U.S. Cl.
CPC ..... *B22D 11/0406* (2013.01); *B22D 11/009* (2013.01); *B22D 11/055* (2013.01);
(Continued)

(58) Field of Classification Search
CPC . B22D 11/0406; B22D 11/009; B22D 11/055; B22D 11/059; B22D 11/07; B22D 11/108; B22D 11/1206; B22D 11/142
See application file for complete search history.

(56) References Cited

U.S. PATENT DOCUMENTS 3,393,727 A * 7/1968 Rys ..... B22D 11/1287 164/424

FOREIGN PATENT DOCUMENTS

CN 202715798 U 2/2013
EP 0686446 † 12/1995
(Continued)

OTHER PUBLICATIONS

A. Volkert et al., High Casting Capacity with Spray Cooled Moids on the Billet Casters at BSW, Proceedings, 3rd International Steel Conference on New Developments in Metallurgical Process Technologies, pp. 743-750, Jun. 2007 (D2).
(Continued)

*Primary Examiner* — Kevin P Kerns
*Assistant Examiner* — Steven S Ha
(74) *Attorney, Agent, or Firm* — K&L Gates LLP

(57) ABSTRACT

Continuous casting apparatus, comprising a mold and a crystallizer for the continuous casting of a metal product. The mold is provided with primary cooling means using a cooling fluid and associated with the walls of the crystallizer. A plurality of cooling members is installed downstream of the mold to perform a secondary cooling of the product, said cooling members comprising a plurality of delivery nozzles configured to deliver a liquid for cooling the product.

8 Claims, 4 Drawing Sheets

(51) Int. Cl.

| | |
|---|---|
| ***B22D 11/055*** | (2006.01) |
| ***B22D 11/059*** | (2006.01) |
| ***B22D 11/07*** | (2006.01) |
| ***B22D 11/108*** | (2006.01) |
| ***B22D 11/12*** | (2006.01) |
| ***B22D 11/14*** | (2006.01) |

(52) U.S. Cl.

CPC ..... *B22D 11/059* (2013.01); *B22D 11/07* (2013.01); *B22D 11/108* (2013.01); *B22D 11/1206* (2013.01); *B22D 11/142* (2013.01)

(56) References Cited

FOREIGN PATENT DOCUMENTS

| | | | | | |
|---|---|---|---|---|---|
| EP | 0686446 | A1 | | 12/1995 | |
| EP | 0875312 | A1 | | 11/1998 | |
| JP | 06134550 | A | * | 5/1994 | ..... B22D 11/00 |
| JP | 2013785 | A | | 1/2013 | |
| WO | WO-2010057967 | A1 | * | 5/2010 | ..... B22D 11/04 |
| WO | 2016178153 | A1 | | 11/2016 | |
| WO | WO-2018229808 | A1 | * | 12/2018 | ..... B22D 11/009 |

OTHER PUBLICATIONS

International Search Report for corresponding application PCT/IT2020/050162 filed Jun. 26, 2020; Mail date Sep. 8, 2020.

Written Opinion for corresponding application PCT/IT2020/050162 filed Jun. 26, 2020; Mail date Sep. 8, 2020.

The Making, Shaping and Treating of Steel, 11th Edition, 2003, pp. 1-1032 (D4).†

L. Entesano et al., High-Speed Casting: A New Concept in Billet Shape for Rebar Production, AISTech 2018 Proceedings, AIST (2018) (D1).†

A. Volkert et al., High Casting Capacity with Spray Cooled Molds on the Billet Casters at BSW, Proceedings, 3rd International Steel Conference on New Developments in Metallurgical Process Technologies, pp. 743-750, Jun. 2007 (D2).†

* cited by examiner

† cited by third party

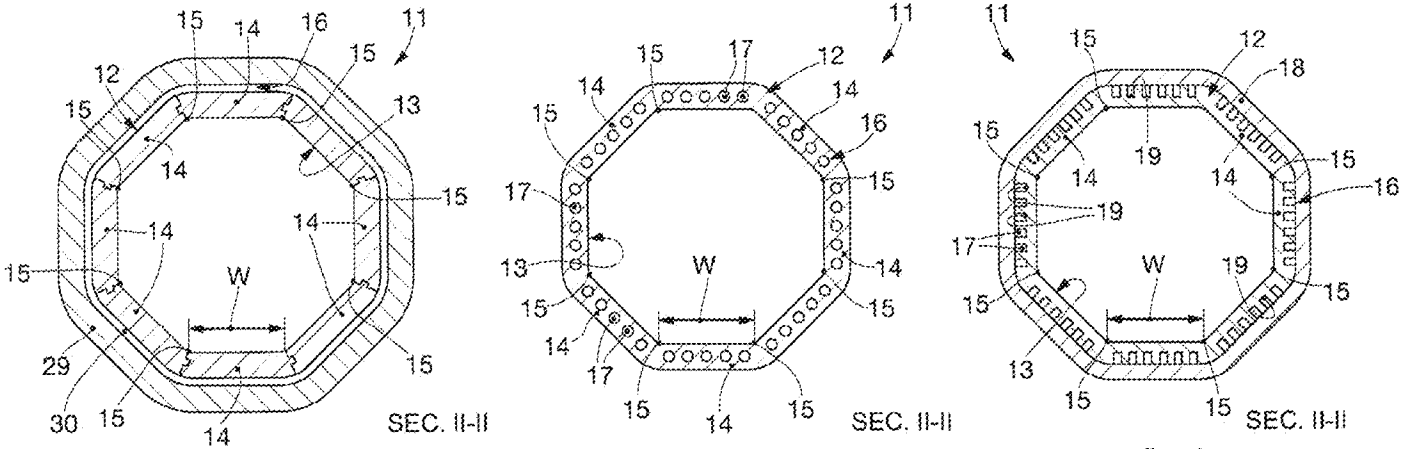
SEC. II-II
fig. 2
SEC. II-II
fig. 3
SEC. II-II
fig. 4
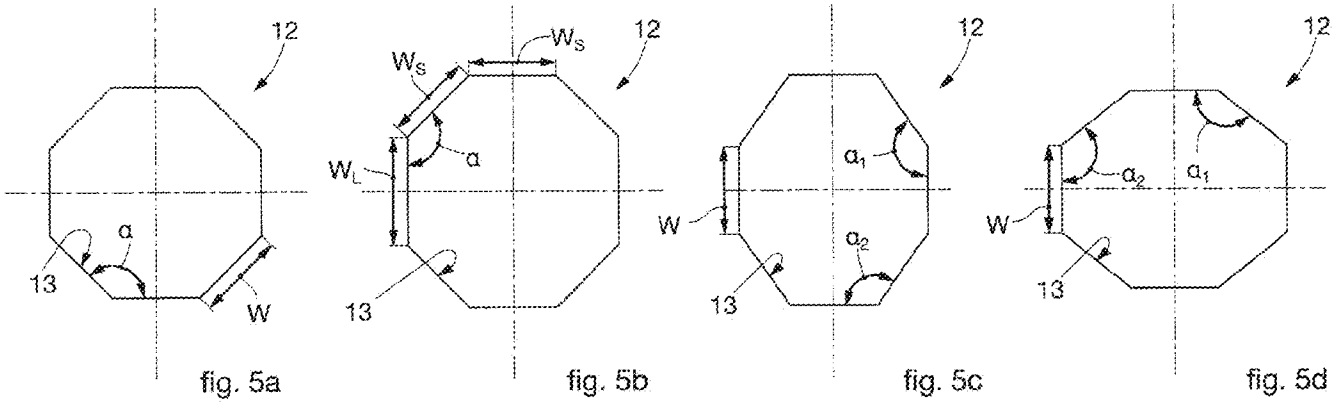
fig. 5a
fig. 5b
fig. 5c
fig. 5d

SQARE-OCTAGON COMPARATIVE TABLE FOR CASTING WITHOUT CONTAINMENT

| | | SQUARE | | | | | | | | Equivalent octagon, that is, with equal section area | | | | | | |
|---|---|---|---|---|---|---|---|---|---|---|---|---|---|---|---|---|
| Crystallizer length | Useful length | Side | Section area | Maximum casting speed | Maximum productivity | | Permanence time | Thermal flow in the crystallizer | | Distance between opposite walls | Maximum casting speed | Maximum productivity | | Permanence time | Thermal flow in the crystallizer | |
| [mm] | [mm] | [mm] | [mm²] | [m/min] | [kg/min] | [t/h] | [s] | medio [kW/m²] | al menisco [kW/m²] | [mm] | [m/min] | [kg/min] | [t/h] | [s] | medio [kW/m²] | al menisco [kW/m²] |
| 1000 | 880 | **100** | 10000 | **6,5** | 507 | 30,4 | 8,1 | 3509 | 8772 | **110** | **15,0** | 1170 | 70,2 | 3,5 | 5330 | 13325 |
| 1000 | 880 | **110** | 12100 | **5,9** | 557 | 33,4 | 8,9 | 3343 | 8357 | **121** | **12,8** | 1208 | 72,5 | 4,1 | 4924 | 12309 |
| 1000 | 880 | **130** | 16900 | **5,0** | 659 | 39,5 | 10,6 | 3077 | 7693 | **143** | **9,8** | 1292 | 77,5 | 5,4 | 4305 | 10771 |
| 1000 | 880 | **140** | 19600 | **4,7** | 719 | 43,1 | 11,2 | 2984 | 7459 | **154** | **8,8** | 1345 | 80,7 | 7,0 | 3780 | 9449 |
| 1000 | 880 | **150** | 22500 | **4,5** | 790 | 47,4 | 11,7 | 2919 | 7298 | **165** | **8,0** | 1404 | 84,2 | 7,0 | 3780 | 9449 |
| 1000 | 880 | **165** | 27225 | **4,2** | 892 | 53,5 | 12,6 | 2820 | 7051 | **181** | **7,0** | 1486 | 89,2 | 7,5 | 3641 | 9103 |
| 1000 | 880 | **190** | 36100 | **4,0** | 1126 | 67,6 | 13,2 | 2752 | 6881 | **209** | **6,1** | 1718 | 103,1 | 8,7 | 3399 | 8497 |
| 1000 | 880 | **200** | 40000 | **4,0** | 1248 | 74,9 | 13,2 | 2752 | 6881 | **220** | **6,0** | 1872 | 112,3 | 8,8 | 3371 | 8427 |

fig. 9a

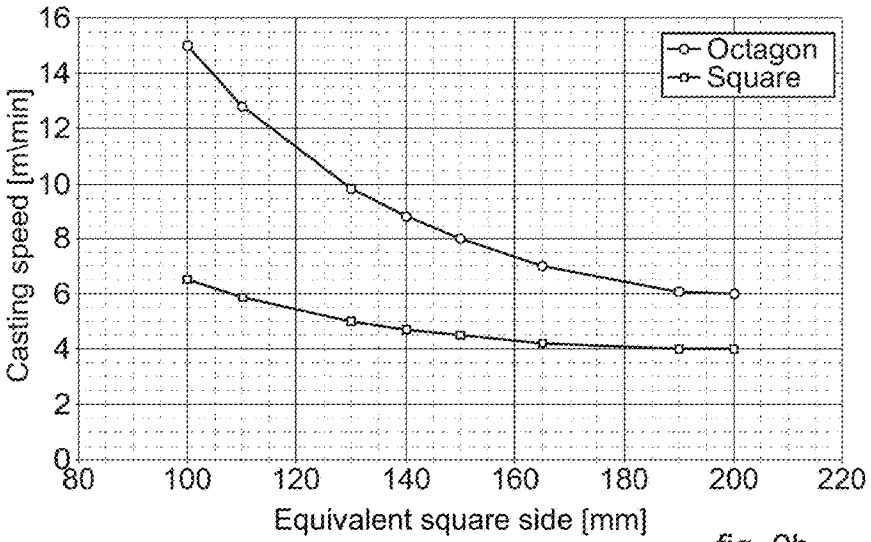

fig. 9b

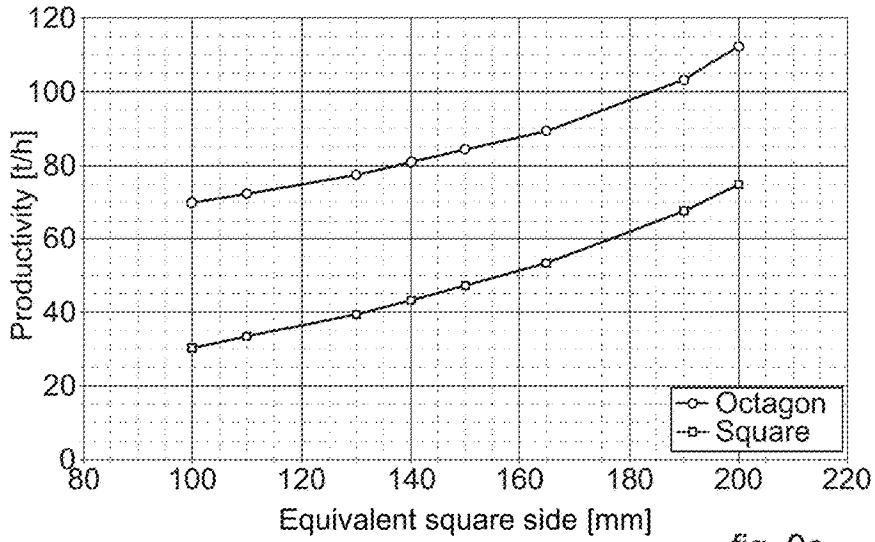

fig. 9c

CRYSTALLIZER FOR THE CONTINUOUS CASTING OF A METAL PRODUCT, AND CORRESPONDING CASTING METHOD

CROSS REFERENCE TO RELATED APPLICATIONS

This application is a continuation of and claims priority under 35 U.S.C. § 120 to U.S. patent application Ser. No. 17/614,718, which was filed on Nov. 29, 2021 as the U.S. national stage of International Patent Application No. PCT/IT2020/050162, which itself was filed on Jun. 26, 2020 claiming priority to Italian Patent Application No. 102019000010347 filed on Jun. 28, 2019. The entire contents of the aforementioned applications are herein expressly incorporated by reference.

FIELD OF THE INVENTION

The present invention concerns an apparatus for the continuous casting at high speed of metal products, such as billets or suchlike.

In particular, the apparatus according to the present invention comprises a crystallizer that allows to cast billets with a much higher casting speed than known crystallizers, increasing productivity, maintaining a high quality of the product and without requiring containing devices downstream of the crystallizer.

The apparatus according to the present invention is particularly suitable for casting and rolling processes using the endless mode, that is, without interruptions between casting and rolling.

It is understood that the crystallizer as above can also be used for other casting and rolling modes, such as billet-to-billet or semi-endless for example.

BACKGROUND OF THE INVENTION

It is known that in continuous casting plants the heart of the casting machine consists of the crystallizer into which the liquid metal is introduced in order to be progressively solidified, with the formation of a solid external shell.

The crystallizer is defined by a tubular body, or mold, made of copper or copper alloy, which is cooled by means of a forced-circulation cooling fluid which indirectly removes heat from the liquid metal by means of the heat exchange between it and the walls of the crystallizer in contact with the cooling fluid. This cooling performed by the crystallizer is called primary cooling.

By means of this heat exchange, the liquid metal begins to solidify externally, causing the formation of a surface skin that thickens as the product gradually approaches the exit of the crystallizer. The thickness of the surface skin is influenced by the casting speed which determines the time that the metal remains in the crystallizer.

At exit from the crystallizer, the solidified external shell still contains some liquid metal inside it, which progressively continues to solidify along the casting line.

As the sizes of the casting section and the casting speed increase, therefore as the thickness of the skin decreases, it is generally necessary to provide a certain number of roller-type containing sectors downstream of the crystallizer, along the curved segment of the casting machine; the rollers are disposed substantially around the entire section of the cast product. The containing sectors are configured to prevent swelling or bulging outward, or so-called "bulging", of the billet walls that would occur due to the ferrostatic pressure exerted by the liquid metal head in the crystallizer. This bulging phenomenon occurs mainly in the case of casting billets with a square or rectangular section with at least one side of a size greater than 150 mm and a casting speed greater than 4.5-5.0 m/min. The swelling or bulging can lead to the formation of cracks which, if they extend up to the external surface, cause the skin to break, with consequent leakage of liquid metal (breakout) and consequent interruption in the production, dirtying and damage to the plant, and potential danger for the workers. As we said above, to prevent this from happening, the state of the art provides to use a plurality of containing rollers, organized in sectors, which peripherally surround all the sides of the square or rectangular billet downstream of the crystallizer.

The position of the containing rollers with respect to the external surface of the billet must be carefully adjusted in order to correctly contain the sides of the section.

The position of the containing rollers must be adjusted considering at least the dimensional shrinkage of the material, due to cooling along the casting line, and the need not to excessively compress the product so as not to deform it and therefore not to hinder its advance along the casting line. In fact, if for some reason the contact between the skin and the containing sectors were to take place not in the best possible way, then there are concrete possibilities that the skin may be pinched or torn, thus incurring potential breakouts.

The operations to adjust the alignment of the containing rollers are required every time a breakout occurs, or when a deterioration in the quality of the cast product is detected, for example due to the presence of internal or surface cracks. The alignment operations are complex and are carried out manually off-line by specialized operators, requiring several hours of work and consequently affecting the operating maintenance costs.

Furthermore, the maintenance of the containing sectors requires adequate spare parts in the warehouse, with related management costs, and imposes constraints on the operation of the casting machine if multiple breakouts occur which are close to each other in time.

Downstream of the crystallizer, for example, in the interspaces between the containing rollers when present, devices are provided to cool the billet, such as nozzles to deliver the cooling liquid, which serve to progressively solidify the liquid metal contained inside the external shell until the complete solidification of the billet is obtained. This cooling is called secondary cooling.

In continuous casting plants, the need to reach high casting speeds is known, in order to increase the overall production capacity of the plants.

It is also known that reaching high casting speeds is correlated to the optimization of a plurality of technical and technological parameters thanks to which the liquid metal is partly solidified in the crystallizer.

The parameters as above mainly concern:

- the geometric and dimensional characteristics of the crystallizer,
- the rigidity of the crystallizer,
- the primary cooling modes of the crystallizer, on which the ability to remove heat inside a predetermined length depends,
- the lubrication modes of the internal walls of the crystallizer.

It is known that in the state of the art, square section billets of relatively small sizes, that is, with sides comprised between 100 mm and 150 mm, normally allow to reach casting speeds of 4.5-6.5 m/min without requiring containment downstream of the crystallizer. This speed can be significantly increased with respect to the values indicated above, while still guaranteeing the quality of the product and the stability of the process, only on condition that a containing device of adequate length is adopted. At high casting speeds, in fact, the skin exiting the crystallizer is thinner and hotter and tends to "bulge" more under the action of ferrostatic pressure, as described above.

For larger square sections, for example with a side of more than 170 mm, the containment requirement occurs at lower casting speeds, for example of 4.0-4.5 m/min.

Square section billets also have a non-uniformity in the surface temperature between the center-face of the flat walls and the edges; this non-uniformity is present both inside and outside the crystallizer, causing defects during the casting step and/or in the subsequent rolling processes downstream, as explained below.

In a square-section crystallizer, uncontrolled states of contact may arise between the skin being formed and the internal walls of the crystallizer, for a certain segment below the meniscus, in which an uneven heat exchange occurs along the perimeter of the billet, which entails a difference in the thickness of the skin that is being solidified.

In particular, each edge of the billet being formed is subjected to a more intense cooling since it is subjected to simultaneous cooling on both sides adjacent to the same edge. Therefore, in correspondence with the edges the skin forms more quickly than in the flat zones, and also the shrinkage of the solidified material in the edges is faster, but this determines the detachment of the skin from the crystallizer, thus reducing the heat exchange.

As one gets closer to the edges, there is therefore a worsening of the contact, and therefore a decline in the ability to remove heat, and the liquid metal consequently has difficulty in solidifying. This results in localized thinning of the skin near the edges.

By way of example only, for a small format square billet, that is, with a side of 100-150 mm, cast at a speed of 4.5-6.5 m/min, it can be estimated that at exit from the crystallizer the thickness of the skin is about 11 mm-13 mm in correspondence with the center-face, while it is about 5 mm-7 mm in the proximity of the edge.

At exit from the crystallizer, since there is no contact between the faces of the billet and the walls of the crystallizer, the ferrostatic pressure causes the sides of the billet to bulge outward. The deformation due to the bulging of the sides is concentrated in the zones near the edges where the skin is already thinned, for the reasons explained above, and determines traction on the internal part of the skin, that is, on the solidification front, in the proximity of the edges, triggering internal cracks in the casting direction.

These cracks, also called "off-corner cracks", lead to a decline in the quality of the billet and can lead to deformations of the cast section, for example accentuating the rhomboid shape, and in extreme cases they can reach the external surface, causing the skin to break and resulting spillage of liquid metal.

The rhomboid shape is further accentuated by the secondary cooling provided at exit from the crystallizer. The rhomboid shape effect also has repercussions downstream from the casting, for example, in the rolling stands, causing jamming.

Furthermore, the frequency of these problems increases as the casting speed increases, which imposes a limit on the maximum achievable speeds and therefore on the productivity of the casting machine.

The phenomena described above occur in billets with four-sided (quadrangular) sections because these sections have flat walls angled at 90 degrees; moreover, these phenomena are accentuated when the connection radii between the walls are particularly low, for example for small billets such radii are 4-6 mm.

As we said, outside the crystallizer, the billet is subjected to secondary cooling along the entire casting curve in order to complete the solidification of the product which still has a liquid core at exit from the crystallizer. Following the secondary cooling, the edges are colder than the center-face since they receive cooling simultaneously on the two sides of the edge and this can cause the onset of defects and/or cracks in the zone of the edges in the subsequent rolling step.

All the problems described above with reference to square section tubular crystallizers have, until now, significantly limited the casting speeds obtainable.

It is known that the production of round section billets allows to reduce, or even eliminate, the containing sectors along the casting line, compared to the production of square section products, thanks to the greater capacity of the round product to support itself and resist the ferrostatic pressure of the liquid metal contained by the solidified skin.

It is also known that the casting of round products allows to have a high cooling homogeneity of the cross section of the cast product, since there are no edges, and therefore a high quality of the cast product itself.

On the other hand, however, round products do not allow to reach high casting speeds since the internal taper of the crystallizer, although studied and optimized, does not allow in all process conditions a perfect and constant contact with the cast product, and therefore, during shrinkage, the solidified skin tends to detach itself from the walls of the crystallizer, reducing the uniformity of the heat exchange.

Usually round sections equivalent to square sections with a side of 100-150 mm are cast with rather low casting speeds comprised between 3 and 4 m/min.

The production of metal materials with a polygonal section is also known, as described in document JP-A-06.134.550, which concerns an apparatus for the continuous casting of billets and, more particularly, to a mold having a polygonal section and a support device comprising a plurality of groups of compression rollers below the mold.

The application WO-A-2018/229808 in the name of the present Applicant is also known, which describes a continuous casting method in which a polygonal crystallizer is used and the casting parameters are optimized to obtain a certain productivity without requiring the use of sectors to contain the cast metal product downstream of the crystallizer itself.

The present invention therefore proposes to supply an answer to the problems indicated above, supplying a solution which allows to reach casting speeds much higher than in currently known solutions, in particular, but not only, for co-rolling processes in endless mode, and therefore to increase the productivity of steel plants.

The purpose of the present invention is in fact to reach casting speeds higher than at least 6 m/min, and up to 15 m/min, without using any containing device downstream of the crystallizer and along the casting curve.

Another purpose is to increase productivity to over 50 tons/h, up to 150 tons/h.

Another purpose of the present invention is to obtain cast products with an optimal surface and internal quality.

The purpose of the invention is in fact to produce steel products with the guarantee of avoiding bulging phenomena that lead to the breakage of the skin, so as not to require devices to contain the billet downstream of the crystallizer.

Furthermore, the present invention also intends to eliminate the occurrence of internal cracks in the zone of the edge, called "off-corner cracks", as well as to make the solidification uniform over the entire perimeter of the tubular crystallizer, eliminating the occurrence of a rhomboid shape in the cast product.

Another purpose of the present invention is to reduce investment costs (CAPEX) and operating costs (OPEX) also through the considerable reduction of maintenance interventions.

Another purpose of the invention is to provide a crystallizer for continuous casting suitable to be inserted in a casting and rolling plant in which the respective processes are directly connected and take place without interruption in the flow of material, that is, in the so-called endless mode.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

Embodiments of the present invention concern an apparatus for casting a metal product, comprising a crystallizer that has specific geometric, sizing and technological characteristics for the continuous high-speed casting of steel products, in particular billets with a small section.

According to the embodiments, a crystallizer is provided with an octagonal-shaped cross-section and contained, as is known, in a mold.

With the term "octagonal", here and hereafter in the description and claims, we mean only that the section of the crystallizer comprises eight sides, comprising both regular octagons, that is, with equal sides and internal angles, and also irregular octagons, that is, with some, or all, the sides and/or angles different from each other.

The Applicant has tested that by casting a product with an octagonal-shaped section it is possible to reach higher casting speeds than in known solutions, for example from 6 m/min up to 15 m/min, and at the same time it is possible to increase the self-supporting capacity of the solid structure of the product even for rather thin skin thicknesses.

Thanks to this self-supporting capacity, the containing devices downstream of the crystallizer can be completely eliminated. In fact, it is a characteristic of the invention to be able to cast a billet with an octagonal-shaped section at the speeds mentioned above comprised between 6 and 15 m/min without needing to provide specific roller type containing sectors.

The octagonal shape of the cross-section, thanks to its geometric characteristics which optimize the compromise between square section and round section, limiting their respective and contrasting disadvantages and maximizing their respective advantages, gives the metal product exiting the crystallizer a remarkable structural rigidity, significantly limiting the deformability of the walls.

According to some embodiments, the crystallizer is provided with high efficiency primary cooling devices to achieve a high heat exchange between the internal wall of the crystallizer and the skin of the product, with a thermal flow value in correspondence with the meniscus greater than 6 $MW/m^2$ and up at 14 $MW/m^2$ and with an average value comprised between 3 MW/m 2 and 5.5 $MW/m^2$.

Since the thickness of the skin is proportional to the amount of heat subtracted, the greater the heat exchange, the greater the casting speed can be. Other conditions being equal, the crystallizer according to the invention therefore allows to increase the casting speed with a consequent increase in the productivity of the plant.

Cooling devices can be made according to different construction forms.

According to one possible variant, the cooling devices comprise a jacket outside the crystallizer in which the cooling fluid is circulated.

According to another possible solution, the cooling devices comprise a plurality of longitudinal channels, made in the thickness of the lateral walls, which develop in a direction substantially parallel to the longitudinal development of the crystallizer.

According to another variant, the crystallizer is provided on its external surface with a plurality of grooves open toward the outside and parallel to the longitudinal development of the crystallizer which are closed by bands of fibers, for example carbon, impregnated with a polymeric resin, to define the cooling channels.

The solution of producing cooling channels directly in the thickness of the copper part of the crystallizer, combined with the presence of a closing element made with bands of fibers, is particularly advantageous since on the one hand it allows to take the cooling liquid extremely close to the steel to be cooled, and on the other hand guarantees a high structural rigidity of the crystallizer.

To compensate for the narrowing of the section of the semi-finished steel product caused by its cooling, the crystallizer is provided with an internal taper of the single type, or also, advantageously, of the multiple or parabolic type, such as to guarantee a continuous contact of the semi-finished product with the walls of the crystallizer.

If of a single type, the internal taper of the crystallizer has values comprised between and 1.5%/m.

If of a multiple or parabolic type, the internal taper of the crystallizer has values comprised between 2 and 4%/m in the meniscus zone and between 0.2 and 1.0%/m in the lower part of the crystallizer, with an average value comprised between 0.8 and 1.5%/m.

According to the invention, the crystallizer has a cavity with an octagonal-shaped cross-section with a distance between two opposite walls comprised between 110 mm and 220 mm, advantageously comprised between 110 mm and 200 mm, even more advantageously between 120 mm and 180 m.

The octagonal crystallizer according to the invention also has a length, determined along the casting line, which can be comprised between 500 mm and 1500 mm, preferably between 600 mm and 1200 mm and even more preferably between 780 mm and 1100 mm.

It can therefore be seen that, compared to an average value of the crystallizers normally used, there is a greater length which allows to increase the contact time between the wall of the crystallizer and the steel, and therefore to obtain the formation of a thickness of the skin at exit from the crystallizer suited to the casting speed and the taper used.

The Applicant has experimented that in order to cast at high speeds and to obtain a good quality of the product (also on rolled products) it is advantageous to use powders as a lubrication system and to discharge the liquid metal from the tundish to the crystallizer through a submerged discharger.

In accordance with possible embodiments, the mold can comprise a plurality of foot rolls, integrated with it and disposed at the exit end of the crystallizer.

The foot rolls guide the exit of the cast product and have the function of keeping it centered in the crystallizer so that the walls of the cast product are all in contact with the respective internal surfaces of the crystallizer and therefore the heat exchange is uniform on all faces.

In possible implementations of the invention, the foot rolls are connected to, and integrally mobile with, the mold.

In light of the above, it is therefore possible to keep the high quality characteristics of the cast product and to keep the casting speed high from 6 m/min up to 15 m/min, thus obtaining a high productivity of the plant comprised between approximately 50 ton/h and about 150 ton/h.

DESCRIPTION OF THE DRAWINGS

These and other characteristics of the present invention will become apparent from the following description of some embodiments, given as a non-restrictive example with reference to the attached drawings wherein:

FIG. 2 is a cross-sectional view, along the section line II-II, of FIG. 1;

FIG. 3 is a variant of FIG. 2

FIG. 4 is another variant of FIG. 2;

FIGS. 5*a*-5*d* schematically show possible cross-section shapes of the crystallizer according to the present invention;

FIGS. 9*a*, 9*b* and 9*c* show a table and two corresponding graphs comparing a casting that uses a crystallizer with square section and a casting that uses a crystallizer with an equivalent octagonal section.

To facilitate comprehension, the same reference numbers have been used, where possible, to identify identical common elements in the drawings. It is understood that elements and characteristics of one embodiment can conveniently be incorporated into other embodiments without further clarifications.

DESCRIPTION OF EMBODIMENTS

We will now refer in detail to the various embodiments of the invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Before describing these embodiments, we must also clarify that the present description is not limited in its application to details of the construction and disposition of the components as described in the following description using the attached drawings. The present description can provide other embodiments and can be obtained or executed in various other ways. We must also clarify that the phraseology and terminology used here is for the purposes of description only, and cannot be considered as limitative.

Embodiments of the present invention concern a tubular type crystallizer for continuous casting indicated by reference number 12, and configured to solidify the liquid metal which is introduced inside it and produce a cast product P at exit.

Figure 1:
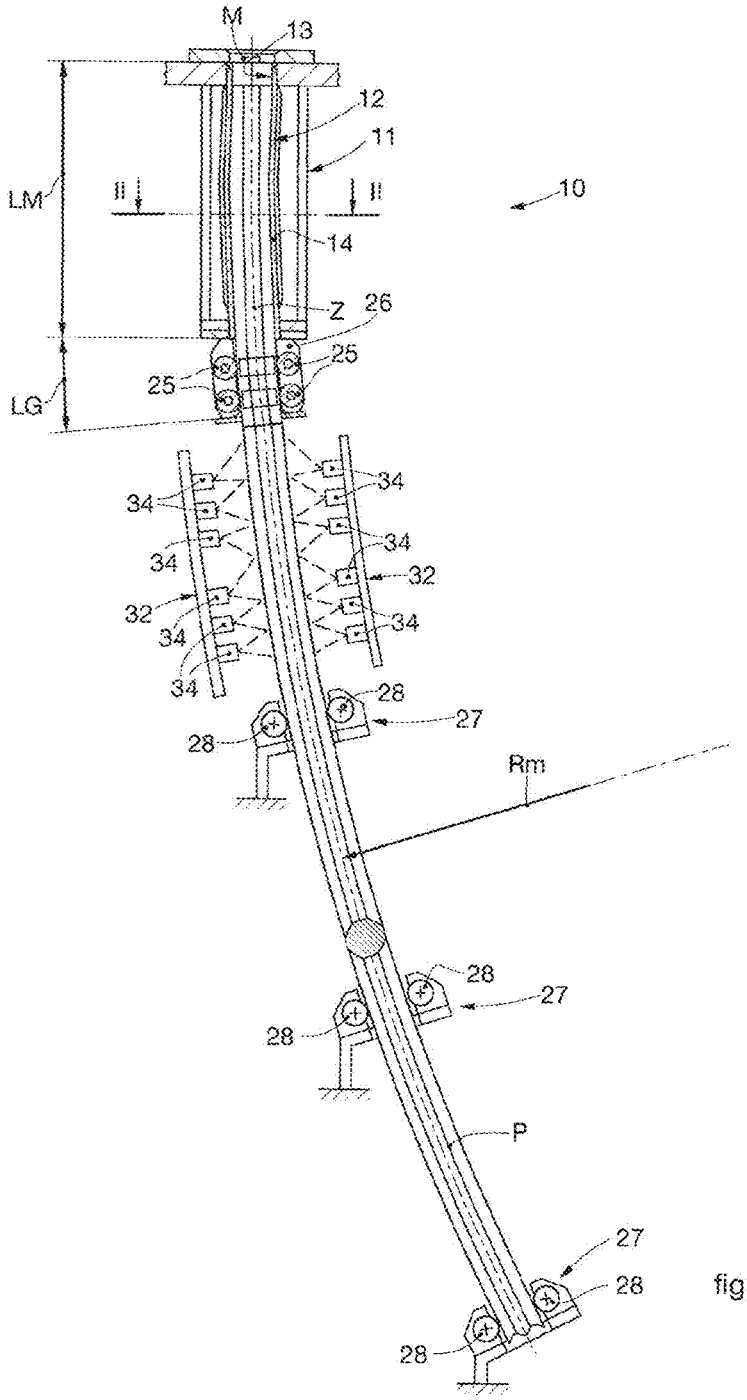
FIG. 1 is a schematic lateral view of a continuous casting apparatus, in which a crystallizer in accordance with the present invention can be used.

In accordance with FIG. 1, a continuous casting apparatus is schematized, indicated as a whole with reference number 10, in which the crystallizer 12 is associated in a known manner with a mold 11 and defines a casting line Z along which the product P in the process of being solidified transits.

The crystallizer 12 has a crystallizer length LM, determined along the casting line Z. Such crystallizer length LM can be comprised between 500 mm and 1500 mm, preferably between 600 mm and 1200 mm and more preferably between 780 mm and 1100 mm.

The crystallizer 12 (FIG. 2 and subsequent) has a casting cavity 13 with a substantially octagonal-shaped cross-section, defined by eight walls 14 connected to each other in correspondence with as many edges 15.

The cross-section of the casting cavity 13 will therefore define the shape of the cross-section of the cast product P at exit from the crystallizer 12. For this reason, in particular linked to a uniformity of cooling, it is preferable, although not strictly binding, that the shape of the octagon is symmetrical with respect to two axes orthogonal to each other.

In particular, such axes define respectively the right-left symmetry and the intrados-extrados symmetry of the section.

FIGS. 5*a*-5*d* show possible embodiments of the octagonal section of the casting cavity 13 of a crystallizer 12.

According to possible embodiments, the section of the crystallizer can be a regular octagon with the sides, that is, the walls, all equal to each other, of a length W and the angles (a) between the sides which are also equal to each other and equal to 135 degrees (FIG. 5*a*).

In accordance with other possible embodiments, it is provided that the sides may have different lengths, wherein the difference in length between the longest side ($W_L$) and the shortest side ($W_S$) of the crystallizer can vary from 5% to 20%, preferably from 5% to 10%.

In these embodiments, the section of the crystallizer can therefore have 6 sides, opposite each other, of a shorter length $W_S$ and 2 sides, opposite each other, of a greater length $W_L$, wherein the angles ($\alpha$) between the adjacent sides are all equal to each other, of a value of 135 degrees, in order to respect the symmetry of the section around the respective axes, as in the example shown in FIG. 5*b*.

According to other possible variants, of which a possible example is shown in FIG. 5*c*, the section of the crystallizer can have sides all of equal length (W) and disposed so as to form angles of different width ($\alpha_1$ and $\alpha_2$), wherein the opposite angles as above are equal to each other with a value comprised between about 125 degrees and about 145 degrees, preferably between about 130 degrees and 140 degrees.

FIG. 5*d* shows a variant of the section represented in FIG. 5*c*, in which the section of the crystallizer is rotated by 90°, consequently, the cast product P will have intrados and extrados sides that are different from those of the cast product P generated by the section in FIG. 5*c*.

The edges 15 are advantageously connected with a connection radius comprised between 5 mm and 25 mm, preferably between 10 mm and 15 mm. The connection radius defines an area in which the heat exchange is much greater than the median of the walls. This exchange tends to create the detachment of the solid skin formed by contact of the liquid metal on the walls of the crystallizer and therefore causes the lack of a correct heat exchange, with a consequent localized reduction of the thickness of the skin and the risk of formation of longitudinal cracks which can also lead to breakage of the skin and leakage of liquid metal (breakout).

The choice of connecting the walls of the crystallizer, obtaining a corresponding section shape of the cast billet, on the other hand benefits the subsequent rolling operations, where a more rounded angle reduces or prevents the phenomenon of laps. Higher connection radius values, on the other hand, are more sensitive to the formation of longitudinal cracks that can be prevented by carefully choosing the connection radius as a function of the section and taper, in order to maintain the contact between the skin and the crystallizer wall sufficient for a uniform distribution of the heat exchange even in the corner region.

In accordance with possible embodiments (FIG. 2), the walls 14 can be distinct elements separate from each other and connected in correspondence with the edges 15 by connection means, for example threaded.

According to possible variants (FIGS. 3 and 4), the walls 14 can be made, or connected together, in a single body to define a monolithic body.

The walls 14 of the crystallizer 12 can have the same thickness to ensure uniformity of cooling of the cast product P and advantageously have a reduced thickness, comprised between 12 and 30 mm such as to ensure an adequate rigidity of the crystallizer.

The crystallizer 12 is provided with cooling devices 16, also called primary cooling devices, configured to cool the liquid metal in contact with the walls 14. Such primary cooling devices are advantageously high efficiency ones, in order to achieve a high heat exchange.

According to one possible variant (FIG. 2), the cooling devices 16 comprise an external jacket 29 into which the crystallizer 12 is inserted. Between the external jacket 29 and the crystallizer 12 a hollow space 30 is defined, which externally surrounds the entire crystallizer 12 and in which, during use, the cooling fluid is circulated.

According to possible solutions of the invention, the cooling devices 16 (FIGS. 3 and 4) comprise cooling channels 17 associated with the crystallizer 12 and in which a cooling fluid is circulated.

In particular, according to one possible variant (FIG. 3), the crystallizer 12 can be provided, in the thickness of the walls 14, with a plurality of cooling channels 17 which develop in a direction substantially parallel to the longitudinal development of the crystallizer.

According to another variant (FIG. 4), the crystallizer 12 is provided on its external surface with a plurality of grooves 19 open toward the outside and parallel to the longitudinal development of the crystallizer 12 itself.

In accordance with one possible solution (FIG. 4), a coating layer 18 is applied on the external surface in order to close the grooves 19 with respect to the outside and define the cooling channels 17. The coating layer 18 can be made with bands of fibers, for example of carbon, wrapped around the axis of the casting line Z and impregnated with a polymeric resin.

According to other solutions, the grooves 19 can be closed to define the cooling channels 17 according to one and/or the other of the embodiments described in WO-A-2014/207729 in the name of the Applicant.

Advantageously, for all these variants, in order to maximize the heat exchange, the distance between the cooling fluid and the internal walls of the crystallizer in direct contact with the liquid metal is minimized. This distance is measured in a direction orthogonal to the axis of the crystallizer and has a value comprised between 8 mm and 10 mm. According to one possible solution, the cooling devices 16 can comprise feeding and evacuation members, not shown in the drawings, and configured to circulate the cooling fluid along the cooling channels 17.

According to the invention, the pressure of the cooling fluid in the segment corresponding to the upper zone of the crystallizer 12, which corresponds to the vicinity of the meniscus, is comprised between 6 and 20 bar, while in the lower zone of the crystallizer, which corresponds substantially to the end part of the crystallizer, it is comprised between 2 and 10 bar.

Inside it, the crystallizer has a substantially conical development gradually narrowing downward from the meniscus zone to the exit zone of the crystallizer, in order to follow the progressive shrinkage of the billet as it gradually cools down along the crystallizer, thus defining a slope of the internal walls with respect to the longitudinal axis of the crystallizer.

The typical unit of measurement of the taper is expressed in %/meter.

As is known, a crystallizer can have a single taper for its entire height ("single" taper) or it can have different tracts or segments with decreasing taper values from the entry section to the exit section ("multiple" taper), which varies stepwise from one segment to the next, thus defining a line broken at several points between the consecutive segments. The multiplicity of the multiple taper is normally double, triple, quadruple. Above the quadruple, it is usual to define the multiple taper as a "parabolic" taper, since the broken line has tens of points and is such as to approximate a continuous variation of the taper, within the working tolerances of the internal walls of the crystallizer.

According to the invention, the internal taper of the crystallizer can be of the single type or even of the multiple or parabolic type.

If of the single type, the taper has values comprised between 0.8%/m and 1.5%/m.

If of the multiple or parabolic type, the taper has values comprised between 2.0 and 4.0%/m in the meniscus zone and between 0.2 and 1.0%/m in the lower part of the crystallizer, with an average value comprised between 0.8 and 1.5%/m.

Thanks to the internal conical configuration of the crystallizer, it is possible to limit the detachment of the billet from the walls of the crystallizer to a minimum, since the shrinkage of the billet is compensated by the narrowing of the section of the central cavity.

A billet with an octagonal-shaped section, compared to a square-shaped one with an equivalent section (area), has the advantage of having a higher and also more uniform average distribution of the temperature on the external surface of the cross-section, with particular regard to the zones of the edges. The temperature delta between the edges and the face center is very low, in the order of 8-15° C. compared to an equivalent square section in which the difference is in the order of 40-65° C. Furthermore, the internal zone (or core) of the octagonal-shaped section is on average warmer than a square section, therefore it has a more favorable enthalpy average.

The octagonal billet also has advantages in the rolling process: in fact, since the obtuse angle between the sides of the section is more open, it allows for a greater analogy with the round section and therefore a lower risk of the so-called "laps" during the rolling step and therefore fewer defects on the rolled products.

In addition, since as explained above the obtuse angle of the octagonal billet has a higher temperature, it entails less wear of the channels of the rolling cylinders.

The octagonal shape also allows advantageously to have greater uniformity of heat exchange in the crystallizer, in particular in the zone immediately below the meniscus, that is, the instance there is the greatest heat exchange and coinciding with the formation of the first skin. This greater uniformity translates into a thickness of the skin that is more homogeneous on the perimeter, both between one side of the product and the other, and also along the same side.

A skin with homogeneous thickness is less subject to the formation of cracks under the skin which can lead to breakouts.

The cooling device according to the present invention is configured so as to allow to exchange high thermal flows in a relatively small distance, that is, within the length of the crystallizer defined above. These thermal flows are greater than about 6 $MW/m^2$ and can reach up to 14 $MW/m^2$ in correspondence with the meniscus, for casting speeds comprised between 6 m/min and 15 m/min. Considering the average values, the thermal flow is comprised between 3 MW/m 2 and 5.5 $MW/m^2$.

In accordance with possible solutions, the octagonal-shaped crystallizer according to the present invention is configured for high productivity, that is, higher than 50 tons/h and up to about 150 tons/h, also in accordance with the method described in WO-A-2018/229808 in the name of the Applicant.

As is known, the liquid metal produced in the melting furnace of the steel mill is discharged from the ladle to a tundish below, and from there it is continuously discharged inside the crystallizer until a determinate upper level, or meniscus M, is reached.

One of the fundamental conditions in the casting process is to work as much as possible in stationary conditions, in particular in the meniscus zone. In fact, meniscus perturbations are responsible for most of the defects found downstream, from cracks to the rhomboid shape.

Furthermore, the reduction of the friction force between the cast product and the internal wall of the crystallizer constitutes another important condition for increasing the casting speed and improving the quality of the product itself.

For this purpose, as is known, lubricating materials such as powders or lubricating oils are distributed above the meniscus to minimize the friction between the skin being formed and the internal walls of the crystallizer.

The lubricating materials in contact with the liquid metal become liquid or vapor and create a layer of lubricant which is interposed between the liquid metal 12 and the internal walls of the crystallizer.

It is also known that the liquid metal can be discharged from the tundish to the crystallizer through an unguided free jet or through a discharger, the exit end of which is located below the level of the meniscus M (submerged discharger or SES).

The Applicant has experimented that in order to cast at high speeds in stationary conditions and obtain a good quality of the product (also on the rolled product) it is advantageous to use powdered lubricant as a lubrication system in the crystallizer and to discharge the liquid metal from the tundish to the crystallizer through a submerged discharger or SES.

The lubrication powders allow a beneficial insulating effect and a more homogeneous distribution on the meniscus. In particular, the powders are scattered on the metal bath in a suitable quantity, where they melt in contact with the liquid metal forming a surface slag that infiltrates the interstice between the casting metal and the copper of the crystallizer, ensuring the lubrication necessary for sliding.

Such powders are a mechanical mixture of silicates and/or aluminum-silicates of alkaline and/or alkaline-earth metals with the addition of elemental carbon chosen from amorphous graphite, coke or carbon black.

According to one aspect of the present invention, downstream of the mold 11, advantageously, there is no containing device to contain the deformation toward the outside of the faces of the cast product P. The Applicant, in fact, has experimented that, thanks to the sizing and to the appropriate design of the crystallizer 12 as indicated above, it is possible to cast an octagonal-shaped section at high speed without the aid of containing sectors and at the same time prevent the phenomenon of bulging or, worse, break-out of the skin of the cast product P.

By eliminating the containing devices of the state of the art, it is therefore possible to eliminate the periodic adjustment/alignment actions that they require which, as known, are expensive in terms of time and costs.

In accordance with possible implementations of the invention, the mold 11 comprises a plurality of guide rolls, also called foot rolls 25, disposed at the exit end of the crystallizer 12 and which are an integral part of the mold 11.

The foot rolls 25 guide the exit of the cast product P and have the function of keeping it centered in the crystallizer 12 so that the walls of the cast product P are all in contact with the respective internal surfaces of the crystallizer 12 and therefore the heat exchange is uniform on all faces as a result.

In possible implementations of the invention, the foot rolls 25 are connected to, and integrally mobile with, the mold 11.

For this purpose, the foot rolls 25 can be installed on a common support element 26 attached to the mold 11.

In accordance with possible solutions, the foot rolls 25 can be grouped into at least one group of foot rolls, in the case shown in FIG. 1 two groups of foot rolls 25, spaced along the casting line Z. Each group of foot rolls 25 at least partly surrounds, during use, a cross-section of the cast product P.

The foot rolls 25 of each group are located on a same lying plane parallel to the cross-section of the cast product P.

The foot rolls 25 are installed directly downstream of the exit of the crystallizer 12.

In accordance with one possible implementation of the invention, the mold 11 can comprise a number of groups of four foot rolls 25 comprised between 1 and 4, preferably 2.

In accordance with possible solutions, the foot rolls 25 are installed in a longitudinal portion of the casting line Z that has a guide length LG.

The guide length LG can be comprised between 150 mm and 800 mm, preferably between 200 mm and 500 mm.

According to possible implementations, the casting speed Vc is greater than 6 m/min, preferably greater than 6.5 m/min, and can reach up to 15 m/min.

In particular, for an octagonal-shaped section with sizes equivalent to those of a square section with a side comprised between 150 and 200 mm, speeds comprised between 6 and 8 m/min can be reached, while for a side comprised between 100 and 150 mm, speeds comprised between 8 and 15 m/min can be reached.

Such a setting of the casting speed Vc allows to reach high productivity of the steel plant.

In some embodiments, the machine radius Rm, that is, the radius of curvature of the casting line Z, can be a value comprised between 5 m and 25 m, preferably between 7 m and 20 m, even more preferably between 10 m and 15 m, even more preferably between 9 m 12 m.

The skin of the cast product P, at exit from the crystallizer, has to have a thickness such that, under the action of the head of liquid metal, the sides of the cross-section of the cast product are deformed at most by a predefined deflection "f".

Figure 6:
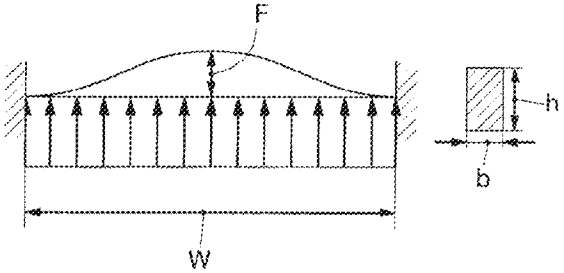
FIG. 6 is a schematic graph of the trend of the deformation deflection of one side of the octagon.

Specifically, the sides of the cast product P behave in a manner that is reasonably close to that of a beam that has its ends embedded and is subjected to a uniformly distributed load which is ferrostatic pressure, as shown in FIG. 6. The section of this beam has a rectangular shape with a smaller side "b" and a larger side "h". The latter represents the thickness of the solidified skin in the flexion plane of the beam.

Figure 7:
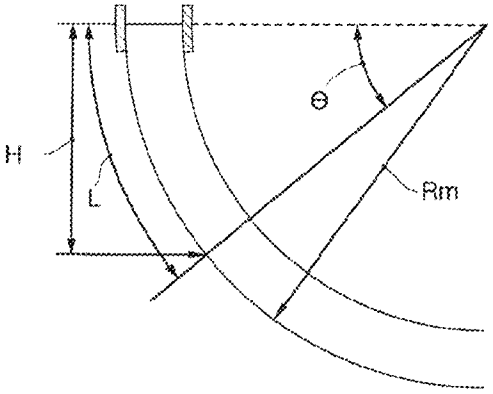
FIG. 7 is a schematic illustration of a casting line.

The deflection "f" can therefore be determined by the relation:

$$f = \frac{p \cdot b \cdot W^4}{384 \cdot E \cdot I}$$

in which:

"p" is the distributed load acting on the skin of the cast product P at exit from the foot rollers 25 and which can be determined by the relation: $p=\rho \cdot g \cdot H$ in which H (FIG. 7) is the height of the head of liquid metal that acts on the skin of cast product P at exit from the foot rollers 25.

H can also be determined as $H=Rm \cdot \sin(\theta)=Rm \cdot \sin(L/Rm)$

W is the length of the side of the regular octagon

E is the elasticity modulus, or the Young modulus, of the cast material

"I" is the surface quadratic moment of the resistant section defined by the relation $$I = \frac{b \cdot h^3}{12},$$

in which "h" represents the thickness of solidified skin, which can also be expressed by the empirical formula $h=K\sqrt{(L/Vc)}$.

The solidification constant K can be determined from literature and is a variable value in relation to the size and type of cast product P and therefore the casting process that is carried out.

In accordance with one possible solution, the admissible deformation deflection "f" of each side of the octagon, that is, the deformation allowed and due to the bulging effect, is less than 5%, preferably less than 3%, even more preferably less 1.5% of the length W of the side of the regular octagon.

The deformation deflection can be expressed in absolute terms and in this case it is indicated with "F", it is measured in millimeters and is obtained as follows: F=f*W.

In accordance with another embodiment of the invention, the apparatus 10 comprises at least one guide mean 27, in this specific case two guide means 27, configured to guide the cast product P along the casting line Z.

In accordance with one possible embodiment of the invention, each guide mean 27 comprises at least one, in this specific case only one, pair of guide rollers 28 positioned respectively on the intrados and extrados side of the cast product P.

The guide means 27 are installed in a fixed position and are configured to guide the cast product P along the casting line Z.

A plurality of cooling members 32 are also provided, installed downstream of the mold 11 and configured to cool the cast product P. Such cooling carried out on the product at exit from the mold 11 is called secondary cooling and serves to condition the solidification process of the still liquid core of the cast product. The cooling members 32 can comprise a plurality of delivery nozzles 34, interposed between the foot rolls 25 and the guide rolls 28, and configured to deliver a liquid for cooling the cast product P, for example water, or a mixed fluid air-water (air-mist).

The delivery pressure at exit from the nozzles can advantageously be comprised between 0.5 and 12 bar, preferably between 1 and 10 bar, even more preferably between 1.5 and 9.5 bar, in order to guarantee a correct cooling and therefore a correct solidification of the cast product P in the speed range from 6 to 15 m/min.

As regards the intensity of the secondary cooling, suitable specific water flow rates have to be guaranteed, for example quantifiable in 1.2-2.5 liters per kg of cast steel, preferably 1.7-2.11/kg, while the cooling density (1/min per $m^2$) has to be higher in the upper part of the casting machine, where the temperatures of the cast product are higher, the vaporization of the cooling water is stronger and the skin is still relatively thin, and therefore the transmission of heat with the liquid core is facilitated.

The homogeneity of temperature on the perimeter of the cross-section can be obtained by appropriately choosing the number of nozzles and the trend of their emission of cooling liquid. It is also advantageous to provide a selective control of the emission of the nozzles between the front and rear side of the cast product P, increasing the emission on the rear side in order to compensate for the lack of stagnation phenomena in the concave zone on the front side.

In order to obtain the homogeneity of the temperatures of the cast product P in the longitudinal direction along the casting line, a dynamic control of the total emission and/or distribution of the cooling density along the casting machine is carried out, in order to keep the surface temperature of the cast product P substantially constant, at a value comprised in the range 900-1200° C., preferably 1,000-1,100° C. The temperature is influenced by a number of parameters such as the size of the cross-section of the cast product, the casting speed, the overheating temperature of the liquid steel, the order of magnitude of the heat exchanges in the mold and the chemical composition of the molten steel. The surface temperatures of the cast product P are calculated by means of suitable solidification models which take into account:

the chemical composition of the steel;

the sensitivity of the steel to thermal gradients (possible internal or surface cracks in the transverse or longitudinal direction);

geometric characteristics of the casting machine;

expected casting speed;

expected metallurgical lengths.

For this purpose, the secondary cooling system is formed with various nozzle zones comanded by sectoral valves for water and/or water-air in the case of "air-mist", which in the upper part of the casting machine can comprise nozzles both on the front and also the rear side, while in the lower part they can be differentiated between front and rear side. These valves can only control some of the nozzles, so as to have more than one active cooling command.

The crystallizer described so far can be advantageously installed in a steel plant in which a casting line feeds the rolling line directly, for example in endless mode, greatly reducing, or even eliminating, the need for intermediate heating, thanks to the greater casting speed and therefore the higher temperature of the cast product.

Figure 8:
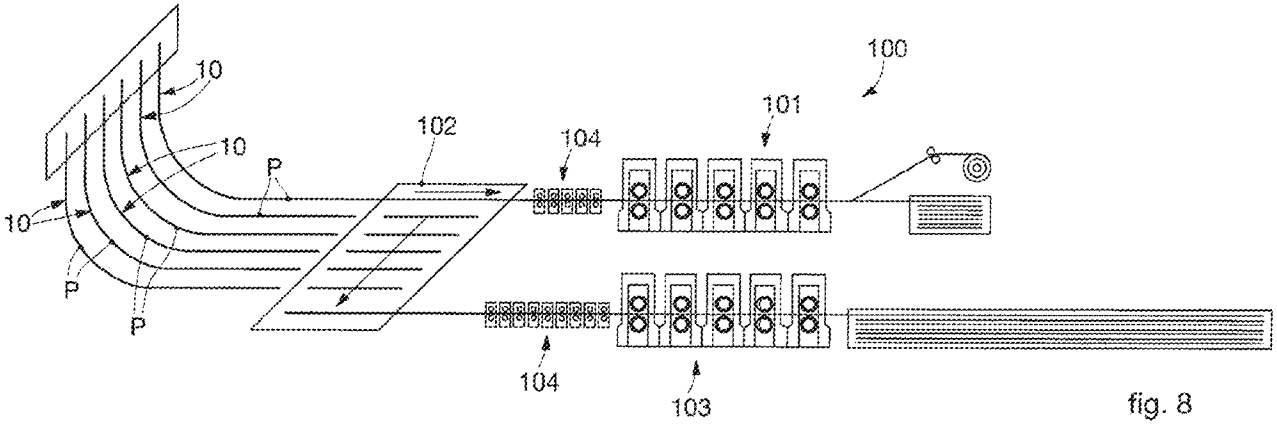
FIG. 8 is a schematic illustration of a possible application of the present invention.

In accordance with possible implementations (FIG. 8), the crystallizer described above can also be installed in a steel plant 100 provided with several casting lines for the production of billets.

The plant 100 can comprise a first rolling line 101 located directly in line with a first casting line and configured to roll the cast product for example in endless mode (co-rolling).

The plant can also comprise additional casting lines, parallel to the first, which feed a second rolling line 103 in direct hot charge mode, by means of a common transfer plate 102 located downstream of the casting lines.

An induction heating device 104 for the rapid heating of the billets can be interposed directly upstream of the first rolling line 101 and/or the second rolling line 103.

To highlight the advantages obtained by using a crystallizer that has the characteristics indicated above, FIGS. 9*a*, 9*b* and 9*c* respectively show a comparison table, and two graphs in which the main casting parameters are compared, without containment, respectively of a square and an octagon with an equivalent section (area).

The length of the crystallizer has been set to 1000 mm with a useful cooling length of 880 mm.

For the side of the equivalent square, lengths comprised between 100 mm and 200 mm have been considered.

As can be seen, the absence of containment makes it necessary to use, in the case of squares, much lower casting speeds, with consequent lower productivity. It is significant to note that the permanence time, in relation to the different casting speed, is much shorter in the case of an octagon compared to that of the equivalent square. The thermal flow is also much greater if casting an octagonal-shaped billet based on the characteristics of the crystallizer described above.

It is clear that modifications and/or additions of parts may be made to the crystallizer as described heretofore, without departing from the field and scope of the present invention.

It is also clear that, although the present invention has been described with reference to some specific examples, a person of skill in the art shall certainly be able to achieve many other equivalent forms of crystallizer 10 and method, having the characteristics as set forth in the claims and hence all coming within the field of protection defined thereby.

The invention claimed is:

1. A method for continuous casting of a metal product, to obtain a productivity between 50 ton/h and 150 ton/h, the method including the following steps:

supplying a continuous casting apparatus, the continuous casting apparatus comprising a mold and a crystallizer for endless, semi-endless, or billet-to-billet continuous casting of a metal product, the crystallizer having a casting cavity into which a liquid metal is cast, and the casting cavity defined by walls connected to each other in correspondence with edges, wherein an upper level of the liquid metal defines a meniscus, wherein said metal product is a billet and comprises an octagonal-shaped billet, and wherein said casting cavity has an octagonal-shaped cross-section with a distance between two opposite walls comprised between 110 mm and 220 mm and a length between 500 mm and 1500 mm;

providing primary cooling means to achieve a heat exchange between the walls of the crystallizer and a skin of the metal product, with a thermal flow value in correspondence with the meniscus comprised between 6 $MW/m^2$ and 14 $MW/m^2$ and with an average value comprised between 3 $MW/m^2$ and 5.5 $MW/m^2$;

providing a plurality of cooling members downstream of the mold to perform a secondary cooling of the cast product, wherein said cooling members comprise a plurality of delivery nozzles that deliver a liquid with a pressure at exit from said nozzles is comprised between 0.5 bar and 12 bar, and wherein specific water flow rates are between 1.2 L/kg of cast steel and 2.5 L/kg of cast steel; and casting at a casting speed between 6 m/min and 15 m/min.

2. The method as in claim 1, wherein a pressure of a cooling fluid of the primary cooling means in a segment corresponding to an upper zone of the crystallizer, which corresponds to a vicinity of the meniscus, is comprised between 6 bar and 20 bar, and wherein the pressure of the cooling fluid of the primary cooling means in a segment corresponding to a lower zone of the crystallizer, which substantially corresponds to an end part of the crystallizer, is comprised between 2 bar and 10 bar.

3. The method as in claim 1, further providing that said product cast product is then subjected to rolling in a rolling line in endless mode, that is, without interruptions between continuous casting and rolling.

4. The method as in claim 1, wherein providing the plurality of cooling members downstream of the mold comprises providing a plurality of delivery nozzles that deliver the liquid with the pressure at exit from said nozzles between 1 bar and 10 bar, in which the specific water flow rates are between 1.7 L/kg of cast steel and 2.1 L/kg of cast steel.

5. The method as in claim 1, wherein supplying the continuous casting apparatus comprises supplying foot rolls, disposed at an exit of the crystallizer, for a guide length comprised between 150 mm and 800 mm, in which the cast product at exit from said mold follows a casting line with an aid of a plurality of guide rolls disposed directly downstream of said foot rolls following a machine radius comprised between 5 m and 25 m.

6. The method as in claim 1, wherein providing the primary cooling means comprises providing a cooling fluid of said primary cooling means a distance from the walls of the crystallizer in contact with the liquid metal, the distance comprised between 8 mm and 10 mm.

7. The method as in claim 1, wherein providing the primary cooling means comprises providing a pressure of a cooling fluid of the primary cooling means in a vicinity of the meniscus is comprised between 6 bar and 20 bar, and in which the pressure of the cooling fluid of the primary cooling means in a zone corresponding to an end part of the crystallizer is comprised between 2 bar and 10 bar.

8. The method as in claim 1, wherein the primary cooling means is configured to exchange thermal flows comprised between 6 $MW/m^2$ and 10 $MW/m^2$.

* * * * *